United States Patent [19]

Brock et al.

[11] 4,443,274

[45] Apr. 17, 1984

[54] PROCESS FOR FORMING A PROTECTIVE FILM ON CU-SN ALLOYS

[75] Inventors: Andrew J. Brock, Cheshire; Frank N. Mandigo, Northford, both of Conn.

[73] Assignee: Olin Corporation, New Haven, Conn.

[21] Appl. No.: 446,758

[22] Filed: Dec. 3, 1982

[51] Int. Cl.[3] ..... C23F 7/12

[52] U.S. Cl. ..... 148/6.31; 148/13.2

[58] Field of Search ..... 148/6.31, 13.2

[56] References Cited

U.S. PATENT DOCUMENTS

| | | | |
|---|---|---|---|
| 115,220 | 5/1871 | Levi et al. | 148/13.2 |
| 1,911,023 | 5/1883 | Kelley | 148/3.2 |
| 2,210,670 | 8/1940 | Kelly | 148/13.2 |
| 2,636,101 | 4/1953 | DePue | 148/13.2 |
| 3,824,132 | 7/1974 | Wolfe et al. | 148/13.2 |
| 3,841,921 | 10/1974 | Shapiro et al. | 148/13.2 |
| 3,923,558 | 12/1975 | Shapiro et al. | 148/13.2 |
| 4,116,686 | 9/1978 | Mravic et al. | 148/13.2 |

FOREIGN PATENT DOCUMENTS

| | | | |
|---|---|---|---|
| 602599 | 3/1978 | U.S.S.R. | 148/13.2 |

OTHER PUBLICATIONS

Copper Development Association, Inc. Standards Handbook, "Wrought Copper and Copper Alloy Mill Products, Part 2–Alloy Data", 1973, pp. 141 and 142.

*Primary Examiner*—Sam Silverberg

*Attorney, Agent, or Firm*—Barry L. Kelmachter; Paul Weinstein; Howard M. Cohn

[57] ABSTRACT

A heat treatment for providing copper-tin alloys with a substantially continuous tin-phosphorous-oxide protective layer that improves the appearance and the tarnish resistance of the alloys is disclosed. The heat treatment comprises heating the alloys in a reducing atmosphere having a dew point of at least about 65° F. and a temperature in the range of about 700° C. to about 900° C. for a time in the range of about 2 hours to about 24 hours.

5 Claims, 1 Drawing Figure

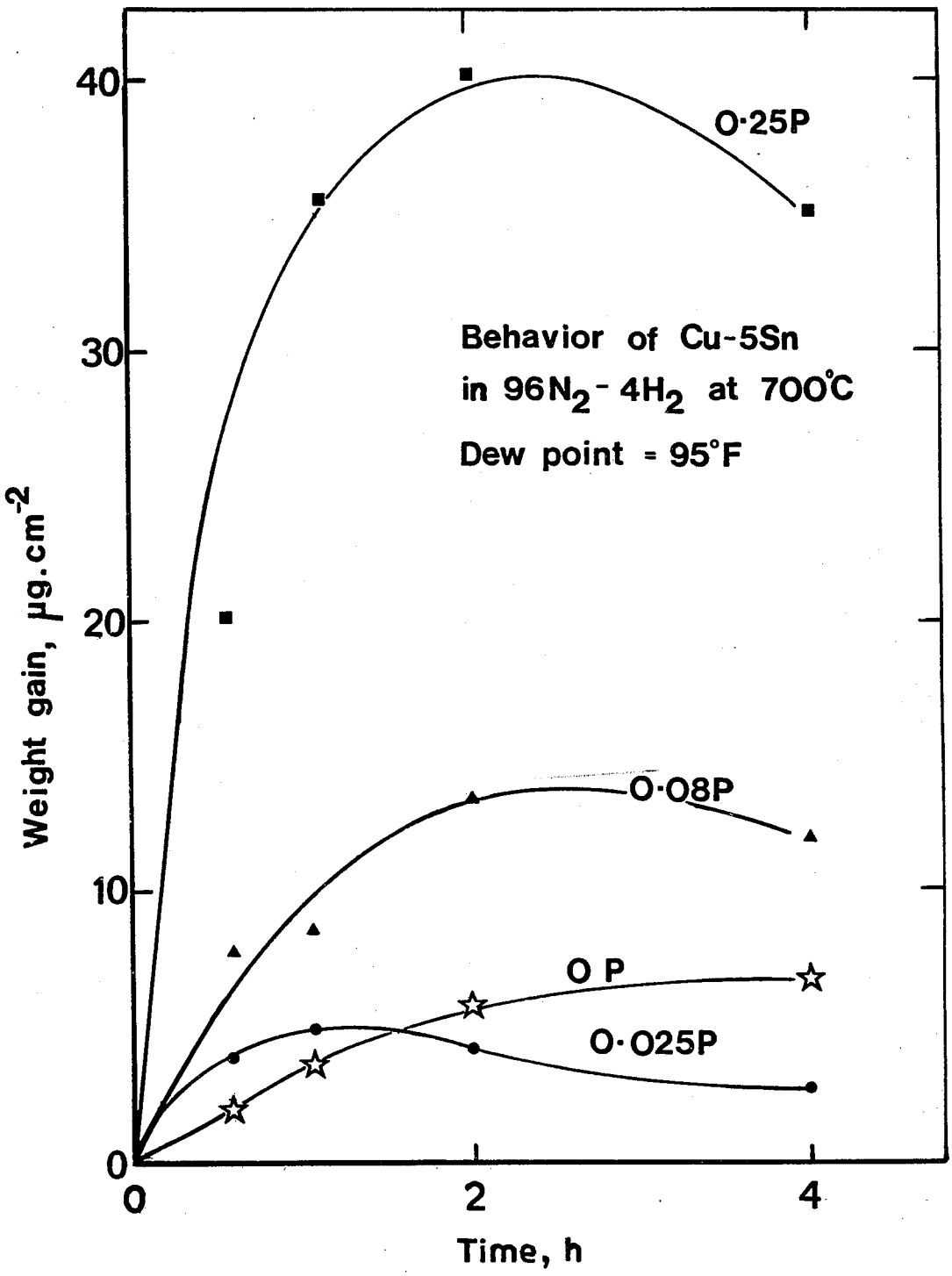
Behavior of Cu-5Sn
in 96N2 - 4H2 at 700°C
Dew point = 95°F
0·25P
0·08P
0 P
0·025P
Weight gain, μg.cm-2
Time, h
0
10
20
30
40
0
2
4

PROCESS FOR FORMING A PROTECTIVE FILM ON CU-SN ALLOYS

This invention relates to the processing of copper base alloys. In particular, it relates to the processing of copper-tin alloys to improve their resistance to tarnishing.

Because of their many desirable properties, copper-tin alloys, particularly phosphor-bronzes, have been used in a wide variety of applications. These applications include ornamental objects, ordnance, machinery components, arc-welding electrodes, and electrical components. U.S. Pat. Nos. 115,220 to Levi et al., 2,210,670 to Kelly, 2,636,101 to DePue and 4,116,686 to Mravic et al. illustrate various phosphor-bronze copper alloys and their applications.

These copper alloys have been subjected to a variety of processes to enhance a particular property and/or to confer certain commercial advantages. For example, in U.S. Pat. No. 3,824,132 to Wolfe et al., a bronze having a substantial delta phase has its wear characteristics improved by heating the bronze to a temperature between approximately 968° F. and 1470° F., holding the attained elevated temperature for a period of time, and then subsequently cooling the bronze. The bronze is held at the elevated temperature for a relatively short time such as, for instance, 15 seconds. In U.S. Pat. No. 3,923,558 to Shapiro et al., a phosphor-bronze copper alloy having improved hot workability at normal commercial hot working temperature and a method of processing the alloy are described. The final condition of the alloy may be either tempered rolled strip of heat treated strip. When in a heat treated condition, the final heat treating process step comprises heating the alloy from 10 seconds to 8 hours at temperatures between 100° C. and 850° C. in order to improve the yield strength and ductility characteristics.

One problem associated with the processing of copper-tin alloys and phosphor-bronzes is the formation of tin sweat during heat treatments. For example, during the short-term annealing of copper-tin-phosphorous alloys in reducing atmospheres at dew points of 65° F. and above, globules of tin containing phosphorous form on the metal surface. These globules leave spots on the alloy surfaces making the surface appearance unattractive and the alloy commercially unacceptable. Another problem is that these alloys tend to tarnish rather easily.

It has been surprisingly discovered that there exists a relatively narrow range of heat treatment temperatures where these tin containing phosphorous globules can be transformed into a protective film. This protective film provides the alloy surfaces with a lustrous appearance and improved tarnish resistance. In addition, the film readily accepts a good solder coating and acts as a solid state lubricant by reducing the surface coefficient of friction of the alloys.

In accordance with the instant invention, copper-tin alloys are subjected to a heat treatment, preferably a final heat treatment, for improving their tarnish resistance and appearance. The heat treatment comprises initially forming tin oxide on the alloy surfaces and thereafter reducing the tin oxide by causing an interaction between the tin oxide and phosphorous. In a preferred embodiment, the phosphorous is contained within the alloy. Alternatively, the phosphorous may come from an external source such as a gas stream containing phosphorous which contacts the alloy during the heat treatment.

It has been found that the heat treatment of the instant invention is particularly useful for improving the appearance and tarnish resistance of copper base alloys comprising from about 2.5% to about 15%, preferably from about 4% to about 8% tin, from about 0.05% to about 1.5%, preferably from about 0.2% to about 0.5% phosphorous, balance essentially copper. When processed in accordance with the heat treatment of the instant invention, these alloys are characterized by a substantially continuous tin-phosphorous-oxide layer or film on their surfaces. This layer adds to the luster of the alloy, improves tarnish resistance, demonstrates excellent solderability characteristics, and acts as a solid state lubricant. In addition, the tin-phosphorous-oxide protective layer may be readily and easily removed.

In accordance with the instant invention, the copper alloys are heated in a reducing atmosphere having a dew point greater than about 65° F., preferably from about 90° F. to about 120° F., at a temperature in the range of about 700° C. to about 900° C., preferably from about 750° C. to about 850° C., for a time period of about 2 hours to about 24 hours. It has been found that the time required to form the desired protective layer decreases with increasing phosphorous content and increasing temperature.

For alloys containing phosphorous, the heat treatment initially forms tin oxide on the alloy surfaces. Thereafter, the phosphorous in the alloy diffuses onto the surfaces and interacts with the tin oxide to form $P_2O_5$ and globules of tin containing phosphorous. After a certain period of time, which is dependent upon the temperature and the phosphorous content of the alloy, the globules are transformed into the protective tin-phosphorous-oxide film.

For copper-tin alloys not containing phosphorous, the alloys are preferably heated in a reducing atmosphere in which a phosphorous containing gas stream flows. The phosphorous in the gas stream interacts with the tin oxide on the alloy surface to form $P_2O_5$ and the tin-phosphorous globules. As before, these globules become transformed into the protective tin-phosphorous-oxide film by continued application of heat.

Accordingly, it is a principal object of the present invention to provide copper-tin alloys with an improved appearance and improved tarnish resistance.

It is a further object of the present invention to provide bronze alloys as above having excellent solderability characteristics and reduced surface friction coefficients.

It is a further object of the present invention to provide a method of providing copper-tin alloys with a protective film that provides said improved appearance, improved tarnish resistance, excellent solderability characteristics and reduced friction coefficient.

Further objects and advantages of the present invention will appear from the following description and figure.

The FIGURE is a graph showing the weight behavior of copper-tin alloys processed in accordance with an embodiment of the heat treatment of the instant invention.

In accordance with the present invention, the foregoing objects and advantages are readily attained.

The copper alloys of the present invention contain from about 2.5% to about 15%, preferably from about 4% to about 8% tin. In a preferred embodiment, the copper-tin alloys also contain from about 0.05% to about 1.5% phosphorous. In a most preferred embodiment, the copper-tin alloys contain from about 0.2% to about 0.5% phosphorous. The balance of these alloys is essentially copper. One or more additional elements can be present in the alloy provided they do not oxidize under the conditions described hereinafter. For the common elements this would include lead, zinc and iron. These elements may be present in the following levels: up to about 0.05% lead, up to about 0.3% zinc and up to about 0.1% iron. Throughout the instant specification, the percentages of alloy components are weight percentages.

The copper base alloy of the present invention may be cast in any convenient manner. The particular method of casting is not especially critical and any convenient method may be employed such as direct chill or continuous casting. After casting, the alloy may be processed in any desired manner. For example, it may be hot rolled at any desired suitable starting temperature. Following hot rolling, the material may be cold rolled to the desired final gage with or without one or more intermediate anneals. The hot rolling, cold rolling, and the intermediate anneals may be performed using any convenient commercial method.

After a final cold roll to finish gage, the alloy is subjected to a final heat treatment which imparts to the alloy an increased resistance to tarnishing as well as an increased luster. The heat treatment of the instant invention comprises heating the copper-tin alloys in a suitable reducing atmosphere at a dew point greater than or equal to about 65° F. Any suitable conventional heating apparatus known in the art may be used to heat the copper-tin alloy.

The reducing atmosphere may contain nitrogen, argon, or any other suitable inert gas. In addition, the reducing atmosphere may contain either hydrogen, carbon monoxide, carbon dioxide, mixtures thereof, or any other suitable gas. If hydrogen is present in the reducing atmosphere, it should be present in the range of from about 0.5% to about 10%, preferably from about 1% to about 5%. If carbon monoxide is present in the reducing atmosphere, it too should be present in the range from about 0.5% to about 10%, preferably from about 1% to about 5%. Examples of suitable reducing atmospheres include 96% nitrogen-4% hydrogen and 10% carbon dioxide, 3% carbon monoxide, 3% hydrogen, balance nitrogen. While dew points equal to or greater than 65° F. are suitable, preferably the reducing atmosphere has a dew point within the range of about 90° F. to about 120° F. If desired, the reducing atmosphere gases may be saturated with water vapor by bubbling them through water at the appropriate dew point temperature.

To provide a protective film on the copper-tin alloys described hereinbefore, the alloys are heated at a temperature within a relatively small temperature range for a time sufficient to create a substantially continuous tin-phosphorous-oxide film on the alloy surfaces. In particular, the final heat treatment comprises heating the alloys at a temperature in the range of about 700° C. to about 900° C., preferably from about 750° C. to about 850° C., for a time in the range of about 2 hours to about 24 hours.

The final heat treatment causes the tin in the alloy to react with water vapor and initially form tin oxide on the alloy surfaces. For the phosphorous containing copper-tin alloys, it is believed that the tin oxide is reduced by the phosphorous which slowly diffuses out from the underlying alloy. It is likely that the phosphorous diffuses to the surface and reduces the tin oxide to tin. This reaction leads to the formation of $P_2O_5$. Some $P_2O_5$ volatilizes with a resultant phosphorous loss. The reduced tin reacts with water vapor to form tin oxide and this combines with $P_2O_5$ to form a mixed oxide which analysis shows to be close to $3SnO_2{:}2P_2O_5$. After a period of time, the whole surface of the alloy is covered with a thin layer of film of the tin-phosphorous-oxide phase.

For alloys containing no phosphorous, the tin oxide formed on the alloy surfaces during heating may be reduced by placing the alloy in contact with an external source of phosphorous such as the reducing atmosphere including a flowing gas stream containing phosphorous vapor or phosphide, $PH_3$. After reducing the tin oxide, $P_2O_5$ is formed. Reoxidation of the tin occurs and the mixed oxide phase containing phosphorous and tin is formed as globules which eventually form the protective tin-phosphorous-oxide film.

At the temperatures used in the heat treatment of the instant invention, tin-phosphorous-oxide containing phase is molten and its surface tension results in the formation of drops or globules. The number, size and rate of formation of the globules increase with an increasing phosphorous content in the alloy. It is believed that the globule formation essentially sweeps the surface free of oxide so that additional oxidation with more globule formation results. This mechanism predicts a higher rate of oxidation for alloys containing a higher phosphorous level. Eventually, the number of globules is such that they touch at which time the surface tensional forces cause an intermediate transition to a continuous layer. This transition does not require gravity flow of the molten globules and occurs equally on horizontal or vertical surfaces.

The tin-phosphorous-oxide layer is extremely thin. For an alloy containing 5% tin, 0.45% phosphorous, balance essentially copper, it is only in the order of about 2$\mu$ thick. The thickness decreases in proportion to the phosphorous content. The layer is glassy in appearance and imparts a glossy appearance to the alloy substrate without affecting the alloy color. During the change from a globular phase to the substantially continuous layer, the alloy appearance changes from frosty to lustrous.

Examination of various surface layers have revealed that the globules containing tin-phosphorous-oxide have a substantially constant tin to phosphorous weight ratio of about 3:1. The composition of these globules does not appear to be related to the phosphorous content of the alloy.

As discussed above, the time required to form the protective tin-phosphorous-oxide layer is a function of temperature and phosphorous content. At a temperature of about 700° C., the layer may be formed after about 12 hours for high phosphorous contents and after about 24 hours for low phosphorous contents. For example, for alloys containing about 0.25% phosphorous, the continuous tin-phosphorous-oxide film can be formed at 700° C. after about 20 hours. At a temperature of about 800° C., the layer may be formed after about 2 hours for high phosphorous contents and after about 16 hours for relatively low phosphorous contents. For example, for alloys containing at least about 0.05% phosphorous, the layer can be formed at 800° C. after about 6 hours. At temperatures below 700° C. and times lower than those discussed above, transition from a globular to a substantially continuous layer could not be attained.

EXAMPLE I

To demonstrate the behavior of copper-tin alloys subjected to the heat treatment of the instant invention, samples containing various phosphorous levels, 5% tin and the balance essentially copper were made. The phosphorous levels were 0.025%, 0.08% and 0.25%, respectively. In addition, a sample containing no phosphorous was also prepared.

The samples were heated to a temperature of 700° C. in a reducing atmosphere comprising 96% nitrogen-4% hydrogen at a dew point of 95° F. The samples were kept at this temperature for at least 4 hours. After relatively short periods of time, tin oxide was formed on the samples. The formation of tin oxide on the samples causes a gain in sample weight. For the various phosphorous containing samples, it can be seen from the FIGURE that a maximum weight gain occurs after about 1 hour to about 2 hours. Thereafter, these samples lose weight. This weight loss can be attributed to the loss of phosphorous, most likely as $P_2O_5$. During the tests, $P_2O_5$ was detected in the exiting gas stream. For these alloy samples, the magnitude of both the initial weight gain and the subsequent weight loss increase with increased phosphorous content.

In the alloy without phosphorous, the weight gain reached a nearly steady-state level after about 2 hours. In addition, no surface globules could be detected.

It has been discovered that the substantially continuous tin-phosphorous-oxide layer formed on the alloy provides the alloy with several very desirable properties. A unique property of this protective layer is its ability to accept a good solder coating. The protective layer also provides the alloy with improved tarnish resistance and a lower surface friction coefficient. To demonstrate these various properties, the following tests were performed.

EXAMPLE II

Copper-tin alloys containing 5% tin, 0.05% and 0.25% phosphorous respectively and the balance consisting essentially of copper were heated for 6 hours at 800° C. in a 96% nitrogen-4% hydrogen reducing atmosphere at a dew point of 95° F. The samples were then immersed in 60–40 tin/lead solder at 460° F. using a rosin flux, 611 flux, for 5 seconds. The resultant solder coatings were bright and generally showed less than 5% dewetting with no evidence of pinholes. In contrast, a sample containing 5% tin with no phosphorous when treated in the same manner gave a solder coating characterized by greater than 50% dewetting with pinholes present.

EXAMPLE III

Phosphorous-containing copper-tin alloys such as those in the previous example were heated for 6 hours at 800° C. in a 96% nitrogen-4% hydrogen reducing atmosphere at a dew point of 95° F. The samples were held in the neck of a bottle of $(NH_4)_2S$. After 20 seconds, these treated samples showed only a faint dicoloration. For comparison purposes, unheated or untreated samples of the same alloys were held in the neck of the bottle of $(NH_4)_2S$. After five seconds, the untreated samples showed interference colors ranging from orange to deep blue.

EXAMPLE IV

A copper alloy sample comprising a copper base alloy containing 5% tin, 0.43% phosphorous and the balance consisting essentially of copper was heated at 750° C. for 24 hours in an Exogas reducing atmosphere at a 70° F. dew point. A plurality of pin-on-disc tests using an E52100 pin at different applied loads were performed on the sample. Each test was a single track test having a test speed of about 250 mm/sec and a total distance of 30,000 mm. No lubricant was used during the test. The applied loads were in the range of about 50 to about 836 grams.

For comparison purposes, an untreated sample of the same alloy was subjected to a plurality of pin-on-disc tests at loads in the range of about 100 to about 600 grams. The other test conditions were identical to those described above.

For the treated sample, the friction coefficients ranged from 0.25 to 0.40. For the untreated sample, the friction coefficients were greater than or equal to 1.0. The friction coefficients of the treated sample were lower than that ordinarily expected of this alloy.

In addition to providing copper-tin alloys with the aforementioned improved properties, the tin-phosphorous-oxide layers produced by the heat treatment of the instant invention may be easily removed. For example, removal of the layer can be brought about by immersion for 30 seconds in boiling 1N. NaOH solution followed by immersion in 12 w/o $H_2SO_4$ for 30 seconds at 50° C.

While the above discussions and examples have been directed to copper-tin-phosphorous and copper-tin alloys, a similar surface film should be achievable on a pure tin or tin-phosphorous substrate.

The patents set forth in the specification are intended to be incorporated by reference herein.

It is apparent that there has been provided in accordance with this invention a process for forming a protective film on copper-tin alloys which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. Process for forming a protective layer on a surface of a copper-tin alloy containing phosphorous comprising: providing an alloy comprising about 2.5% to about 15% tin, about 0.05% to about 1.5% phosphorous and the balance consisting essentially of copper, forming tin oxide on the surface of said alloy and reducing said tin oxide by heating said alloy at a temperature in the range of about 700° C. to about 900° C. in a reducing atmosphere having a dew point of at least about 65° F. for a time sufficient to transform said tin oxide initially into globules of tin containing phosphorous and then into a substantially continuous protective layer of tin-phosphorous oxide.

2. Process for forming a protective layer on a surface of a copper-tin alloy comprising:

providing a copper tin alloy, forming tin oxide on the surface of said alloy and reducing said tin oxide by heating said alloy at a temperature range of about 700° C. to about 900° C. in a reducing atmosphere having a dew point of at least about 65° F. and having a source of phosphorous within said reducing atmosphere for a time sufficient to transform said tin oxide initially into globules of tin containing phosphorous and then into a substantially continuous protective layer of tin-phosphorous oxide.

3. The process of claim 1 wherein said reducing and layer forming step further comprises:

heating said alloy at a temperature in the range of about 750° C. to about 850° C. for a time in the range of about 2 hours to about 24 hours.

4. The process of claim 1 wherein said step of providing a copper-tin alloy comprises:

providing an alloy containing about 4% to about 8% tin, about 0.2% to about 0.5% phosphorous and the balance consisting essentially of copper.

5. The process of claim 1 further comprising:

said dew point being in the range of about 90° F. to about 120° F.

* * * * *